United States Patent [19]

Siegenthaler

[11] 4,302,119

[45] Nov. 24, 1981

[54] MATRIX PRINTER WITH CUTTING DEVICE

[75] Inventor: Fritz Siegenthaler, Trub, Switzerland

[73] Assignee: Autelca AG, Gümligen, Switzerland

[21] Appl. No.: 136,517

[22] Filed: Apr. 2, 1980

[30] Foreign Application Priority Data

Apr. 2, 1979 [CH] Switzerland ..... 3043/79

[51] Int. Cl.[3] ..... B41J 11/70

[52] U.S. Cl. ..... 400/621; 83/627; 101/93.07

[58] Field of Search ..... 400/121, 124, 621, 621.1, 400/621.2; 101/93.07; 346/24; 83/549, 627, 636; 308/6 R

[56] References Cited

U.S. PATENT DOCUMENTS 3,393,459 7/1968 Lanahan et al. ..... 308/6 R
3,799,022 3/1974 Nagel et al. ..... 83/636 X
3,951,252 4/1976 Selke et al. ..... 400/621
4,116,568 9/1968 Suzuki et al. ..... 400/320
4,211,498 7/1980 Shimizu et al. ..... 400/621

*Primary Examiner*—Paul T. Sewell
*Attorney, Agent, or Firm*—Brady, O'Boyle & Gates

[57] ABSTRACT

In a matrix printer, the knife blade (27) of the cutting device for the imprinted paper is integral with a cam carrier of a planar sliding cam drive roller (3) supported on the matrix printing head (1). Three cam sections (41, 42, 43) on the cam carrier are contacted by the drive roller (3) as it moves back and forth with the matrix printing head (1) during printing, and the drive roller contacting one of the cam sections (42) to move the knife blade laterally of the imprinted paper to cut it as it leaves the printing site, and contacting another of the cam sections (43) to return the knife blade to its retracted position.

8 Claims, 6 Drawing Figures

MATRIX PRINTER WITH CUTTING DEVICE

BACKGROUND OF THE INVENTION

Matrix printers for printing on a paper strip taken off from a reel are customarily equipped with a cutting device which, after the respective text has been printed upon the strip, cuts off the thus-imprinted piece of paper from the paper web strip withdrawn from the reel.

In commercial matrix printers of this type, a separate electrical drive mechanism is provided for the cutting device, this drive mechanism constituting an appreciable portion of the volume and weight of the matrix printer.

The object of the present invention is to reduce the weight and volume of a matrix printer equipped with a cutting device.

SUMMARY OF THE INVENTION

A matrix printing head is connected by guide rollers to move forwards and backwards in the line writing direction on a guide rail and a cord and pully system connected to a reversible stepping motor selectively moves the printing head in the line writing direction. The imprinted paper leaves the printing site beneath the printing head between a stationary counter blade and a planar knife blade mounted to be moved at right angles to the line writing direction relative to the counter blade to cut-off the imprinted paper. A cam drive roller on the matrix printing head moves back and forth therewith along a first cam section of the knife blade as the matrix printing head prints line-by-line, and the knife blade remains stationary. When the imprinted paper is to be cut-off it is advanced, the matrix printing head and cam drive roller are moved beyond the end of the printed line causing the roller to lift a lever arm pivoted to the knife blade and pass beyond the free end thereof which is resiliently returned into contact with the first cam section. The lever arm contains an inclined second cam section and on longitudinal return of the matrix printing head the cam drive roller thereon contacts the inclined second cam section and pushes the knife blade downwardly to cut-off the imprinted paper. The full downward cutting stroke is completed by the time the cam drive roller returns over more than half of its longitudinal displacement path and it then leaves the second cam section and contacts a reversely inclined third cam section which, upon further longitudinal displacement of the cam drive roller in the return direction slides the knife blade upwardly and returns it to its retracted position as the third cam section intersects the first cam section and the cam drive roller moves from the third cam section back to the first cam section which is parallel to the guide rail and the line of movement of the matrix printing head.

One embodiment of the matrix printer of this invention is illustrated in the appended drawings with its parts which are important in connection with the invention, in a simplified representation.

DESCRIPTION OF THE PREFERRED EMBODIMENT

Figure 2:
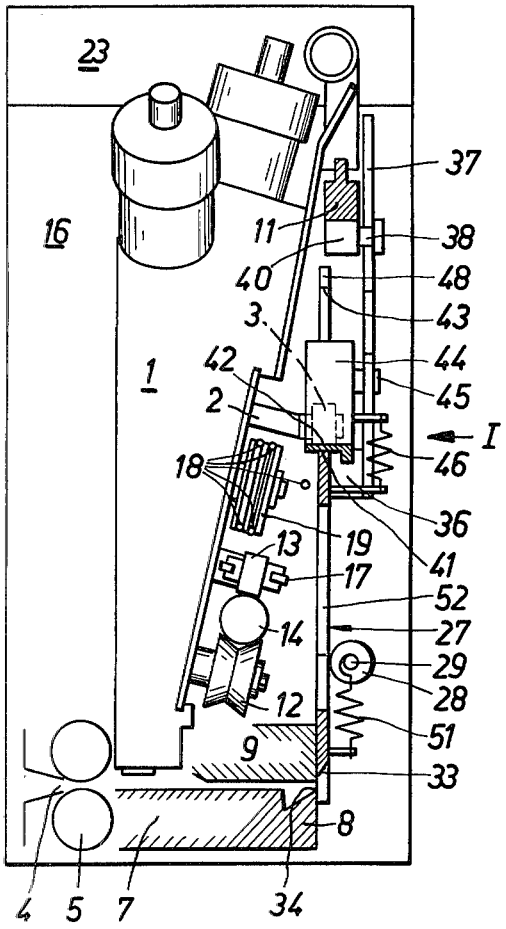
FIG. 2 is a cross-sectional view taken substantially along line II—II in FIG. 1.

In the drawings, the matrix (pin) printing head 1 is illustrated in thinner lines than the other parts, except for the roller 3 pertaining to the cutting device, which is supported on the matrix head on an angled axle 2 as best seen in FIG. 2. In FIGS. 3–6, the matrix head is shown only in contour outline. The paper web, not shown, is conducted from the storage reel, likewise not shown, through a feed slot 4 and between two feed rolls 5, driven by a motor 6, to a pressure bar 7 on which the fixed counter blade 8 of the cutting device is formed. The printing head portion of the matrix printing head 1 is positioned above pressure bar 7 and the paper web to be printed extends between these two members. The pressure bar 7, together with a bar 9 arranged thereabove, defines a guide slot for the imprinted paper leaving the printing zone.

Figure 1:
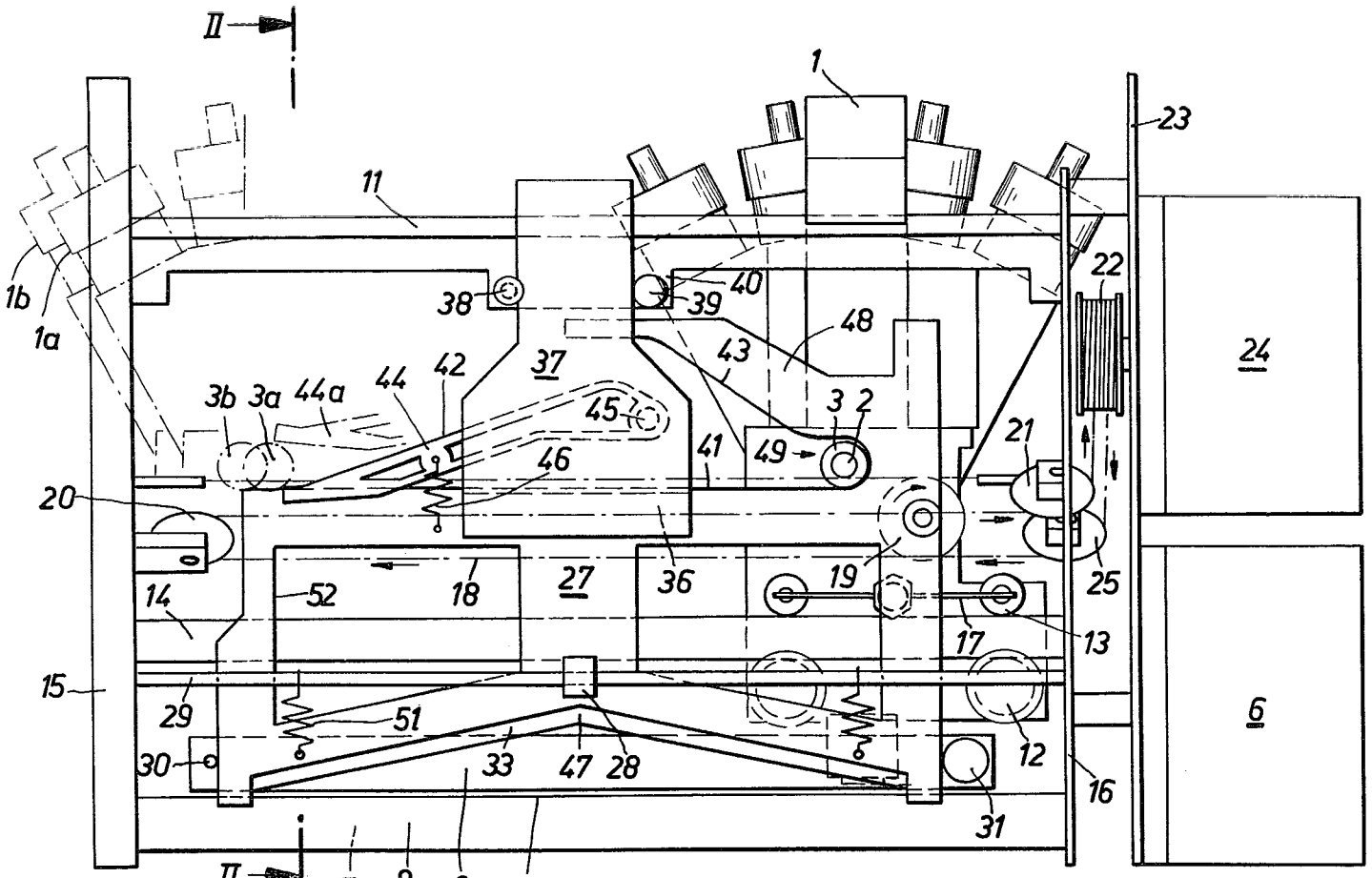
FIG. 1 is a rear elevational view of the interior of the matrix printer (view as seen in the direction I of FIG. 2)

The matrix head 1 is guided slidingly at a guide rail 11 at the top and displaceably at the bottom by means of guide rollers 12 and 13 along a round bar 14 in parallel to the direction of the lines to be printed. The guide rail 11 and the round bar 14 are attached, in the same way as the pressure bar 7, with one end to the sidewall 15, on the left as seen in FIG. 1, and with the other end to a right-hand partition 16. The lower guide rollers 12 are profiled rollers on axles fixedly joined to the matrix head 1. The axles of the upper guide rollers 13 are supported on the bifurcated-slotted ends of a leaf spring 17 attached at its center to the matrix head 1, and for the secure guidance of the matrix head 1, are urged with a spring force exceeding the gravity force of the matrix head against the round bar 14.

A cord drive means is provided for the displacement of the matrix head 1. The elongation-resistant cord 18 of this drive means, illustrated in dot-dash lines, extends from a cord end attached to the sidewall 15 via one peripheral half of a groove of a twin-groove cord pulley 19 supported at the matrix head 1, a cord pulley 20 supported at the sidewall 15, and a cord pulley 21 supported in a recess of the partition 16 to a drive pulley 22, which latter has a helical groove, is arranged between the partition 16 and a right-hand sidewall 23, and is driven by a reversible stepping motor 24. From the drive pulley 22, the cord 18 continues via a cord pulley 25 arranged in a second recess of the partition 16 and over the other peripheral half of the other groove of the twin-groove cord pulley 19 to the partition 16, to which the other cord end is attached.

If the motor 24 drives the cord 18 with the drive pulley 22 in the direction of the arrows indicated in FIG. 1, the matrix head 1 is pulled in the line writing direction, i.e. in FIGS. 1 and 3–6 from the right toward the left, the twin-groove cord pulley 19 rotating in the direction of the arrow indicated in FIG. 1. In case the cord 18 (after reversing the direction of rotation of the motor 24) is driven in the opposite direction, thus also reversing the direction of rotation of the twin-groove cord pulley 19, then the matrix head 1 is pulled from the left toward the right in FIGS. 1 and 3–6.

Figure 6:
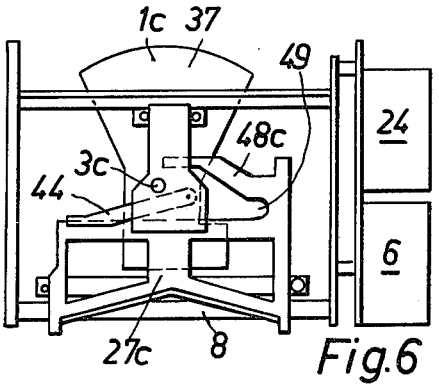

The knife blade 27, shown in FIGS. 1–5 in its rest position and in FIG. 6 (in a position 27*c*) shortly prior to the end of its cutting stroke, is slidingly guided along the counter blade 8 and along the bar 9. A pressure roller 28 on an axle 29 holds the knife blade 27 against the counter blade 8 and the bar 9; a pin 30 and a roller 31 (FIG. 1) guide the knife blade 27 laterally.

The edge 33 of the knife blade 27 extends at an obtuse angle in a V-shape, symmetrically to the perpendicular line of symmetry of the edge 34 of the counter knife 8. Since the edges 33 and 34 thus do not extend in parallel to each other, but rather at a mutual acute angle, a cutting step is executed respectively at two small locations, so that a weak advancing force is sufficient for the knife blade 27. The symmetrical extension of the edge 33 has the effect that the reactive force during the cutting process acts oppositely in parallel to the advancing direction of the knife blade 27, i.e. practically has no component acting on the lateral guidance (pin 30, roller 31 and the pin 38 and roller 39 to be mentioned further below), so that no complicated guide mechanism is required and yet sliding friction is negligible.

The knife blade 27 is fixedly joined by a spacer element 36 to a guide tab 37, which latter is guided slidingly along the rail 11 by means of a pin 38 having a head extending over the guide tab 37, and by means of a roller 39. The pin 38 is attached to an extension 40 of the rail 11, and the roller 39 is supported on this extension 40.

The knife blade 27 constitutes a cam carrier for a cam consisting of three sections 41, 42, 43, of a planar sliding cam drive mechanism, the drive element of which is the roller 3.

The first cam section 41 extends on the rear side of the knife blade (back of the knife blade) at right angles to the advancing direction of the knife blade, i.e. in parallel to the guide means (11, 14) of the matrix head 1, from a point associated with the beginning of the lines to be printed, i.e. from the point at which the roller 3 is in the rest position of the matrix head 1, shown in solid lines in FIG. 1, to a small distance beyond the point at which the roller 3 is at the end of the lines, at which point the matrix head and the roller are denoted, in FIG. 1, by 1*a* and 3*a*.

The second cam section 42 extends substantially at an acute angle with respect to the first cam section 41 and is formed on the side of a cam lever 44 facing away from this first cam section. The cam lever 44 is pivotably mounted to the guide tab 37 about a pin 45 and is with its free end under the action of a tension spring 46 at the location of the first cam section 41 at which the roller 3 is in its aforementioned position 3*a;* this cam lever can be compared to a switching lever [tongue]. The spacing of the pivotably supported end of the cam lever 44 from the first cam section 41 is so large that the roller 3 can pass through between the first cam section 41 and the lever 44 (in FIG. 1 from the right to the left; see FIG. 4). The largest spacing of the second cam section 42 from the first section 41 is equal to the stroke of the knife blade 27, which is only a little larger than the spacing of the apex 47 from the ends of the cutter edge 33 which latter extends in a V-shape at an obtuse angle.

The third cam section 43 is formed at the rim of an arm 48 facing the first cam section 41, this arm being constructed integrally with the knife blade 27. The third cam section 43 emanates from a semicircular arc at the beginning of the first cam section 41 and first extends for a short distance in parallel at a spacing from the first cam section 41 only a little exceeding the diameter of the roller 3, whereby a niche 49 (FIGS. 1 and 4–6) is formed which receives the roller 3 in the rest position of the matrix head 1; the third cam section then continues at an acute angle with respect to the first cam section 41 and finally extends over the pivotably supported end of the cam lever 44 at a spacing which is only a little larger than the diameter of the roller 3.

The pin 45 is arranged above a point of the first cam section 41 having a smaller distance from is beginning (niche 49), on the right-hand side in FIG. 1, than from the left-hand end of the first cam section 41, as seen in this figure. Accordingly, the cam ascent angle of the second cam section 42 is smaller than that of the third cam section 43.

Two tension springs 51 are attached with one end to the axle 29 of the pressure roller 28 and with the other end to the knife blade 27 and maintain the latter in frictional engagement with the roller 3 with the first and second cam sections 41 and 42, respectively, as will be explained in greater detail below.

The knife blade 27 has two trapezoidal recesses 52 to reduce its mass on both sides of the track along which the pressure roller 28 travels on the knife blade, so that a small accelerative force suffices for the advancement of the knife blade 27, and vibrations exert only minimally weak forces on the knife blade 27.

Figure 3:
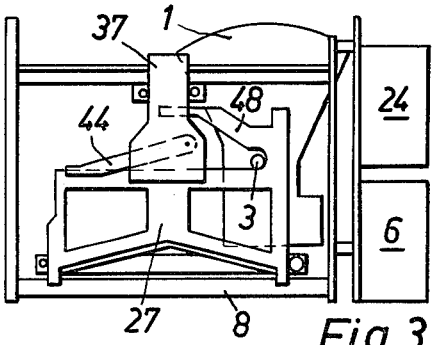
FIGS. 3–6, respectively, are simplified schematic views corresponding to FIG. 1, and showing the matrix head and cutting device in four different operating conditions.

In the rest position of the matrix head 1, the roller 3 supported thereon is disposed in the niche 49 of the knife blade 27 (FIGS. 1 and 3). The knife blade 27 is here fixed in its rest position. For line-by-line printing, the matrix head 1 in each case travels from its rest position 1 into position 1*a* (FIG. 1 and 4) and back. During this step, the roller 3 travels to its position 3*a* and back along the first cam section 41. The knife blade 27 remains stationary. The cam lever 44 is lifted in the position 3*a* of the roller (position 44*a*) and returns to its rest position while the roller 3 travels along the cam section 41 from position 3*a* into its rest position, wherein it is denoted by 3.

If the paper web is to be cut off, the matrix head 1, after printing the last line, is displaced past position 1*a* into position 1*b* (FIGS. 1 and 5), wherein the roller is in position 3*b*. After, by driving the feed rolls 5, the paper web has been conveyed to such an extent that the location to be cut apart is at the edges 33 and 34 (FIG. 2), the matrix head 1 is returned from position 1*b* to the rest position 1. During this procedure, the roller travels from position 3*b*, first of all, along the second cam section 42, pushing the knife blade 27 downwardly. This can be seen from FIG. 6, illustrating the matrix head and the roller in the operating position 1*c* and 3*c*, respectively, shortly before the end of the cutting stroke of the knife blade 27*c*. After the end of the cutting stroke, the roller 3 leaves the second cam section 42, and the knife blade 27 is returned by the springs 51 and/or by the traveling of the roller 3 along the third cam section 43 into its rest position.

Figure 4:
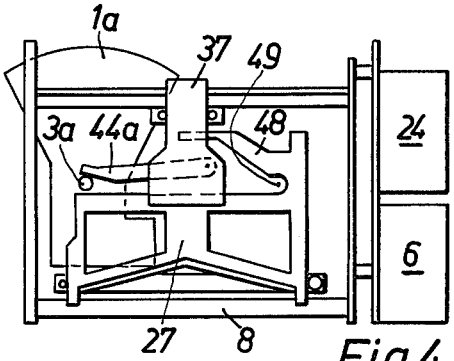
Figure 5:
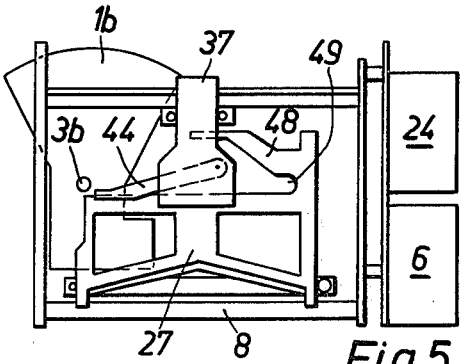

As can be seen, the springs 51 are not absolutely necessary, because the third cam section 43 reliably accomplishes the return of the knife blade 27 into its rest position. The sliding friction of the guide of the knife blade 27 and of the guide tab 37 is sufficient, if no vibrations occur, to maintain the knife blade 27 in its rest position when the matrix head travels from its rest position 1 into its position 1*a* and back, or into position 1*b*. In any event, the tension of the springs 51 can be so small that this tension is negligible with respect to the force required for overcoming the resistance occurring during the cutting step. A very small tension is likewise adequate for the spring 46, so that the advancing force of the roller 3 necessary for lifting the cam lever 44 into its position 44*a* shown in FIGS. 1 and 4 is negligible.

The force to be used for shifting the roller 3 traveling along the second cam section 42 in order to advance the knife blade 27 is much smaller, due to the inclination of the second cam section 42, than the resistance to be overcome for the cutting operation by the knife blade 27, and this resistance is kept small by the angled configuration of the edge 33 of the knife blade 27. The force to be expended by the roller 3 running along the third cam section 43 for returning the knife blade into its starting position is likewise negligible, since this cam section 43 is also inclined; it is merely necessary to overcome the sliding friction of the knife blade 27 and of the tab 37, and the springs 51 can be used as an aid, if desired. In correspondence with the smaller cam ascent angle of the second cam section 42 and the larger cam ascent angle of the third cam section 43, the proportion of the advancing force to be expended at the roller 3 to the resistance to be overcome for the shifting of the knife blade 27 is smaller during the advancement of the knife blade during which the roller (*3c* in FIG. 6) runs along the second cam section 42 and must overcome the shear strength of the paper, and is larger during the retraction of the knife blade during which the roller 3 travels along the third cam section 43, and it is merely necessary to overcome the minor friction resistance of the guide means for the knife blade 27. Thus the power of the motor 24 for the knife blade drive is optimally utilized. The reactive force acting on the matrix head 1 during the cutting step does not increase the guiding resistance of the matrix head, because this resistance is absorbed by the guide rollers 12.

For these reasons it has been found to be sufficient in the present matrix printer to utilize a drive motor 24, dimensioned in the usual way only for the displacement of the matrix head 1, for the additional task of driving the aforedescribed cutting device. In this connection, it must be considered that this motor 24, in a high-speed matrix printer, must also be dimensioned for overcoming the mass moment of inertia of the matrix head at the beginning of its advancing and return movements, and that the roller 3 travels along the inclined, second cam section 42 only after the beginning of the retraction movement of the matrix head 1, during which step the motor 24 need no longer accelerate the matrix head and thus has a power reserve for the shifting of the roller 3 during the cutting step.

The present matrix printer does not require any special control device for the advancement and retraction of the knife blade 27, either. By providing an inexpensive supplement to the control circuit for the stepping motor 24 of the matrix head shifting device, the objective can be attained that this motor continues for several steps after the last line advance of the matrix head 1, whereupon the knife blade 27, during the subsequent retraction of the matrix head 1, is readily advanced and also retracted.

In this way, a matrix printer has been created which is simple and has a low weight, as well as small dimensions.

What I claim is:

1. A matrix printer comprising a matrix printing head (1), a printing site at said matrix printing head, a cutting device (8,27,37) for imprinted paper leaving the printing site, guide means supporting said matrix printing head for longitudinal displacement forwards and backwards in the line writing direction, a displacement drive mechanism (18–22, 24, 25) connected to said matrix printing head for longitudinal displacement thereof, a drive roller (3) connected to said matrix printing head for displacement therewith, said cutting device including a knife blade (27), means connected guide said knife blade (27) displaceably at right angles to the line writing direction, a driven planar sliding cam drive means connected to said knife blade (27) and including cam carrier means (44,48) and cam means (41,42,43), and said drive roller (3) connected to travel along said cam means (41,42,43) and drive said planar sliding cam drive means.

2. A matrix printer as defined in claim 1, in which the cam means includes a first, straight cam section (41) on the rear side of the knife blade (27) and extending in parallel to the guide means (11,14) for said matrix printing head, a second cam section (42) extending substantially at an acute angle with respect to the first cam section (41), a cam lever (44) pivotally connected (45) at one end to said driven planar sliding cam drive means on the side of the first cam section (41) facing away from the edge of the knife blade (27), said second cam section (42) being on said cam lever (44), said one end of said cam lever having a spacing from the first cam section (41) exceeding the diameter of said roller (3), said cam lever having a free end, means (46) resiliently urging said free end into contact with the end of the first cam section (41), said end of the first cam section being associated with the writing line end; said matrix printing head being in a position (1*a*) at the end of its longitudinal displacement path respectively associated with a writing line, whereby said roller (3*a*) projects at most by its radius past said free end of said cam lever (44*a*); and said first cam section having an extension portion of the longitudinal displacement path at the end of which said matrix printing head is in a position (1*b*) whereby said roller (3*b*) is in front of said free end of said cam lever (44) for triggering said cutting head.

3. A matrix printer as defined in claim 2, in which the pivot connection (45) of said cam lever (44) has a greater spacing from the end of the first cam section (41) that is associated with the writing line end than from the beginning of the first cam section (41) that is associated with the beginning of the writing line.

4. A matrix printer as defined in claim 1, including at least one spring (51) connected with said cam carrier (27, 44, 48) and urging the knife blade (27) of said cam carrier in the retracted position, whereby said cam means (41,42) are maintained in frictional contact with said roller (3) supported on the matrix head (1).

5. A matrix printer as defined in claim 1, in which said cutting device includes a fixed counter blade (8) having an edge (34), and said knife blade (27) including a knife edge (33) extending at an obtuse angle in a V-shape symmetrically to the vertical line of symmetry of the edge (34) of the fixed counter blade (8).

6. A matrix printer as defined in claim 2, in which said cam carrier (27,44,48) includes an arm (48) rigidly joined to said knife blade (27), said arm extending over the pivotally connected (45) said one end of the cam lever (44) and spaced therefrom by a distance that is greater than the diameter of said roller (3), a third cam section (43) extending from the beginning of the first cam section (41) associated with the beginning of the writing line, said third cam section extending substantially at an acute angle with respect to said first cam section (41) and being formed on the side of said arm (48) facing said first cam section.

7. A matrix printer as defined in claim 6, in which the parts of the first and third cam sections (41 and 43)

associated with the beginning of the writing line form a longitudinal niche (49) holding said roller (3) in the rest position of the matrix head (1) in the advancing and retraction directions of the knife blade (27).

8. A matrix printer as defined in claim 1, in which said guide means includes a stationary guide bar (14), mutually opposed first (12) and second (13) guide rollers on said matrix printing head (1) connected to guide said matrix printing head along said guide bar, said cutting device including a stationary counter blade (8) having a cutting edge (34), axles connecting said first guide rollers (12) on said matrix printing head (1) on the side of said guide bar facing the cutting edge (34) to absorb the reactive force during the cutting off step of said cutting device, and resilient means connecting said second guide rollers (13) to said matrix printing head (1) and resiliently urging said second guide rollers (13) against the guide bar (14).

* * * * *